US005263075A

United States Patent [19]

McGann et al.

[11] Patent Number: 5,263,075

[45] Date of Patent: Nov. 16, 1993

[54] HIGH ANGULAR RESOLUTION X-RAY COLLIMATOR

[75] Inventors: William McGann, Raynham; Kenneth Ribeiro, N. Reading, both of Mass.

[73] Assignee: Ion Track Instruments, Inc., Wilmington, Mass.

[21] Appl. No.: 820,156

[22] Filed: Jan. 13, 1992

[51] Int. Cl.[5] ..... G21K 1/02

[52] U.S. Cl. ..... 378/147; 378/149; 378/154

[58] Field of Search ..... 378/145, 147, 149, 154; 430/4, 5; 250/505.1

[56] References Cited

U.S. PATENT DOCUMENTS

| | | | |
|---|---|---|---|
| 4,125,776 | 11/1978 | Tosswill et al. | 378/149 |
| 4,127,398 | 11/1978 | Singer, Jr. | 378/149 |
| 4,288,697 | 9/1981 | Albert | 378/149 |
| 4,951,305 | 8/1990 | Moore et al. | 378/147 |
| 5,007,072 | 4/1991 | Jenkins et al. | 378/88 |

OTHER PUBLICATIONS

Knoll, *Radiation Detection and Measurements*, p. 263 (1988).

Hamamatsu Product Bulletin, p. 3 (Dec. 1987).

Thiel et al., "Focusing of Synchrotron Radiation Using Tapered Glass Capillaries," *Physica B*, vol. 158, pp. 314–316 (1989).

Stern et al., "Simple Method for Focusing X-Rays Using Tapered Capillaries," *Applied Optics*, vol. 27, No. 24, pp. 5135–5139 (Dec. 1989).

*Primary Examiner*—David P. Porta

*Attorney, Agent, or Firm*—Hamilton, Brook, Smith & Reynolds

[57] ABSTRACT

A method of producing a high angular resolution collimator implemented in an inspection system for detecting the presence of selected crystalline materials, such as explosives or drugs. The system includes an x-ray source and an array of energy dispersive detectors to sense radiation scattered by the objects being inspected. The collimator includes a bundle of optical fibers bonded together to form a stack of plates having a plurality of microcapillaries therein to pass an x-ray beam therethrough. The method includes the steps of stacking the plates, aligning the plates in registration, and etching an inner core without disrupting registration.

49 Claims, 4 Drawing Sheets

HIGH ANGULAR RESOLUTION X-RAY COLLIMATOR

BACKGROUND OF THE INVENTION

This invention relates generally to the field of radiographic detection systems, and more particularly to coherent x-ray scattering systems using a high resolution x-ray collimator to detect the presence of explosive materials and illicit narcotic substances.

Numerous screening systems have been developed for inspecting cargo such as bags, suitcases, and briefcases at airports and at other secure installations. Of particular concern in the development of such systems has been the detection of concealed weapons, explosives or drugs whose transport is restricted. Unfortunately, many of these illicit materials do not conform to an easily identifiable shape and are not visually detectable in the currently used systems. In particular, many types of explosive materials can be molded into any shape and are not detectable by standard x-ray equipment. Typically, a conveyor transports the items to be inspected into and out of a chamber positioned between an x-ray source. The x-ray source, which comprises a shaped x-ray beam, irradiates the object of interest. Then an array of detectors is used to measure the transmitted intensity. A monitor displays an image of these scanned items. The outline is visually inspected to determine the presence of the objects of concern. This type of conventional x-ray imaging system provides good spatial resolution but is not capable of determining the intrinsic chemical composition of the items in the cargo passing through.

SUMMARY OF THE INVENTION

In order to detect contraband such as explosive materials and illicit drugs, systems employing energy dispersive detectors and radiation collimators are needed. U.S. Pat. No. 5,007,072, issued to Ion Track Instruments on Apr. 9, 1991, discloses such an x-ray inspection system utilizing energy dispersive detectors and radiation collimators. A polychromatic x-ray source is used to irradiate a piece of luggage. The intensity of the diffracted rays are measured simultaneously at a fixed angle of about 2° relative to the primary beam being emitted from the x-ray source. In order for the energy dispersive detector to measure the intensity of the diffracted rays simultaneously at a fixed angle, a collimator must be employed to provide a sufficiently high resolution.

Typical radiation collimators have been used to perform gamma ray spectroscopy in areas such as nuclear medicine. In this field, large gamma ray cameras are used to obtain images of patient's internal organs. These collimators are constructed from lead and generally have a "honeycomb" appearance. The x-rays pass through these open "honeycomb" areas at a solid angle and are measured by detectors. The x-rays which impinge at angles outside the angular resolution of the collimator are absorbed in the lead walls. The typical resolution of these collimators is only a few degrees of arc. The effectiveness of the x-ray detector system disclosed in U.S. Pat. No. 5,007,072 requires a substantially improved collimator with a resolution about 100 times greater than the conventional "honeycomb" collimator. Thus, there is a need for a collimator with greater resolution.

In accordance with a preferred embodiment of the present invention, there is provided a collimator made from a bundle of optical fibers bonded together to form a solid core. The solid core has an inner core and an outer core. The inner core has a plurality of pores or channels extending through it that have been formed by removing the center of each optical fiber. Each channel provides an optical path for the radiation that is between 10 and 20 mm in length where the channel diameter on the order of about 10 microns. Thus the collimator has an aspect ratio of about 1500. In a preferred embodiment the solid core is sliced along its length, defining a stack of plates with the pores of each plate aligned in registration ensuring passage of an x-ray beam therethrough. A housing securing the stack of plates preserves the registration of the pores in each plate relative to the other plates to provide an optical path through each channel of the entire stack.

Pursuant to another preferred embodiment of the present invention, there is provided an x-ray diffraction inspection system for detecting the presence of selected crystalline materials. A light source irradiates an object with an x-ray beam. A collimator excludes unwanted x-rays scattered from the object. The collimator comprises a plurality of plates stacked over each other as described above where each plate is formed from a bundle of bonded glass fibers. The stack of plates have an inner core and an outer core. The inner core has a plurality of holes aligned in registration to ensure passage of x-rays therethrough. A housing encloses the stack of plates to further ensure registration. A detector measures the intensity of scattered light passing through the collimator.

The present invention further includes a preferred method of fabrication for producing a collimator comprising several steps. First, bundle of optical fibers are fused together. Next, the bundle of optical fibers is partially or completely cut along its length to make plates where the bundle of cut fibers are aligned in registration. The cores of the optical fibers extending through an inner core of the bundle are etched without disrupting registration to provide a large number of channels extending through each plate. Adjacent plates are positioned sufficiently close to each other to prevent any substantial drop in intensity of the signal. The distance between adjacent plates is generally less than 1.0 mm, and preferably less than 0.5 mm. Alternatively, the wafers can be completely cut, etched and then mounted into a housing in which the channels are aligned. One or more grooves can be cut longitudinally along the side of the outer core before the plates are separately cut. The groove can be used to align the stacked plates after processing.

The above and other features of the invention including various novel details of construction and combination of parts will now be more particularly described with reference to the accompanying drawings and pointed out in the claims. It will be understood that the particular collimator embodying the invention is shown by way of illustration only, not as a limitation of the invention. The principals and features of this invention may be employed in varied and numerous embodiments without departing form the scope of the invention.

DETAILED DESCRIPTION OF THE PREFERRED EMBODIMENT

Figure 2:
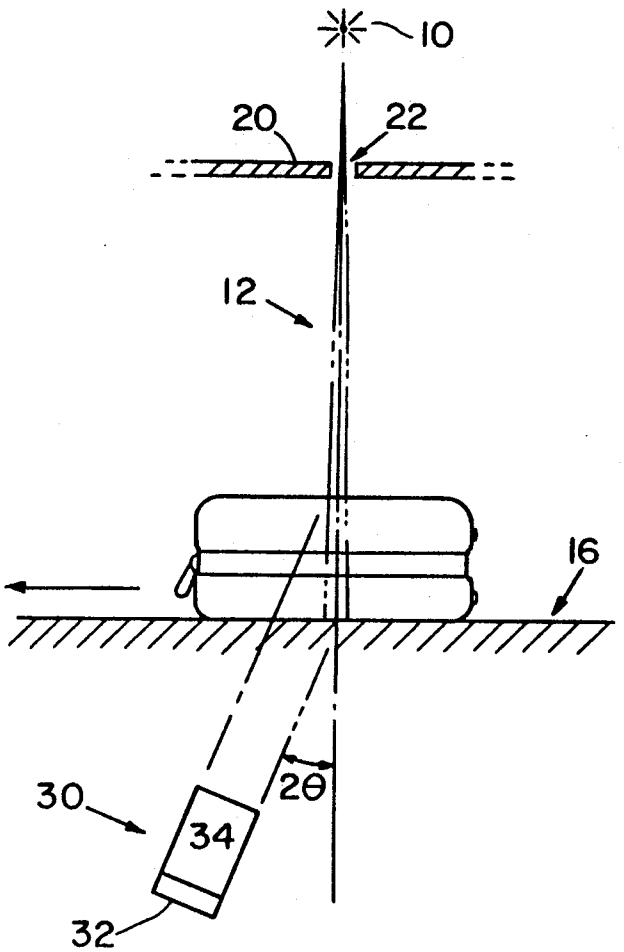
FIG. 2 is a side view of the system shown in FIG. 1.
Figure 1:
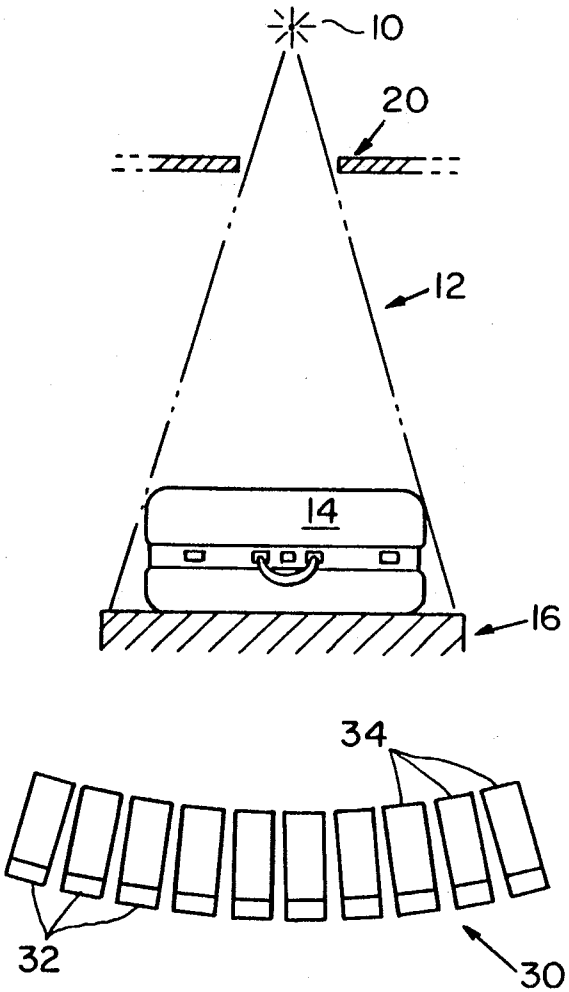
FIG. 1 is a schematical front view depicting an x-ray diffraction inspection system.

A schematic illustration of the x-ray diffraction inspection system incorporating the features of the present invention is shown in FIGS. 1 and 2. This system has sufficient speed of response to detect explosives and illicit drugs in bags being conveyed through a detection zone in a matter of seconds. X-rays from source 10 are arranged in a beam 12 having a fan pattern to irradiate a bag 14 which is conveyed along conveyor 16 through the beam 12. The beam 12 comprises an x-ray continuum whose range of photon energies is sufficient to penetrate large checked bags. The beam 12 is produced by collimation of the single x-ray source 10 of constant potential with slit collimator 20. The polychromatic beam of x-ray photons impinges on the material under test and diffracted intensities are measured at a fixed angle, $2\theta$, with respect to the incident beam using an array of energy dispersive detectors 32.

The detection system of the present invention is comprised of energy dispersive x-ray detectors 32 arranged to measure the coherent elastic scattering of x-ray photons from the lattices of crystalline materials. Such crystalline material comprise crystalline explosives and narcotic or hallucinogenic drugs. Nearly all of the explosives of interest comprise crystalline powders. For example, the plastic explosives are manufactured from crystalline powders of cyclotrimethyline-trinitramine (RDX), cyclotetramethyline tetranitramine (HMX) and pentaerithritol tentranitrate (PETN), and are compounded into a putty with minor amounts of organic binders. Each of the explosives when detected provide a unique diffraction pattern when irradiated with x-rays. Each of these unique diffraction patterns are rapidly recognizable. The only notable exceptions are the nitro-glycerine-based dynamites. Fortunately these explosives are easy to detect by their vapor emissions. A vapor emissions detection system can be integrated with an x-ray diffraction system to form a single detection system. A discussion of how crystalline material in the form of either an explosive or narcotic, scatter when illuminated with an x-ray source is provided in U.S. Pat. No. 5,007,072, which is hereby incorporated by reference.

The detection system 30 measures the intensity of scattered light in intervals of wavelengths over a wide range of photon energies but at a fixed angle $2\theta$ of scatter. This provides a unique fingerprint for each type of explosive or illicit drug. A detailed description of how the detection system works and how the intensity of scattered light is measured is provided in U.S. Pat. No. 5,007,072, which is incorporated herein by reference.

An array of individual energy dispersive detectors 32 is arranged across the full width of the conveyor system and is irradiated by the x-ray fan beam 12. This permits scanning of the whole volume of the bag 14. The source emits polychromatic x-rays ranging between 0–140 keV. The photons scattered through a fixed angle of $2\theta$ are detected and all other scatter angles are precluded by a narrow aperture collimator 34. Thus, the spectrum of x-rays emerge from the sample 14. Only those scattered at or near an angle of $20\theta$ are seen by the detector. In order to detect polychromatic x-rays in this range, the array of energy dispersive detectors 32 are made from high purity Germanium (HPGe). An alternative would be to make the detectors from Cadium Telluride (CdTe).

It is believed that the foregoing description is sufficient for purposes of illustrating the general operation of the x-ray diffraction inspection system incorporating the features of the present invention therein.

Referring now to the specific subject matter of the present invention, the design and process of constructing a high angular resolution collimator will be described hereinafter with reference to FIGS. 3–6.

In order to design a collimator within the above-mentioned diffraction system there are several factors taken into consideration. For example, in detecting illicit narcotic substances there is typically a large field of background scatter. Thus, the collimator must be designed to exclude as much unwanted scatter as possible so that the detector views the diffracted energies of interest. Also, because of the nature of typical cargo or parcels to be inspected and the interplanar spacings of various narcotic substances, the collimator must be constructed from materials which have good stopping power to exclude scattered rays at the higher energies. Another consideration is that the collimator should provide angular resolution which far exceeds the resolution of standard collimators.

To design a collimator in accordance with the above considerations, Bragg's Law is used. The most familiar form of Bragg's Law is defined as:

$$n\lambda = 2d \sin\theta \quad (1)$$

where $\lambda$ is the wavelength of the incident beam (related to the energy by $hc/\lambda$), d is the interplanar spacing between the lattice planes of the crystal (the polycrystal) under study, and $\theta$ is the angle in which the diffracted beam emerges relative to the incident beam. An application of Bragg's Law in detecting a narcotic substance such as cocaine is set forth below. The same calculations could be performed for detecting explosive substances.

Typically, HPGe detectors exhibit about 1 keV of resolution at a beam energy of about 100 keV. The d-spacing for cocaine is 3.315. The angle of detection, $\theta$, is set shallow, 2(degrees), so that the diffracted rays emerge with enough energy to penetrate the cargo. These parameters cause diffracted rays from the cocaine substance to emerge at 53.5 keV. To make full use of the HPGe detector, the angular resolution of the collimator is determined by plugging in 54.5 keV into the Bragg equation and working backwards to determine the angle of diffraction. The angle of diffraction is determined to be 1.96° or an angular deviation of 0.04°. This angular deviation which is represented by the solid angle, $\Omega$, subtended by the detector, corresponds to 2.4′ of arc. Therefore, the collimator must have an angular resolution of no worse than 2.4′ of arc.

Constructing a high angular resolution collimator in accordance with the above design parameters requires that the material be easy to handle and fabricate as well as have good stopping power to minimize background scatter of the high energy photons.

Figure 3:
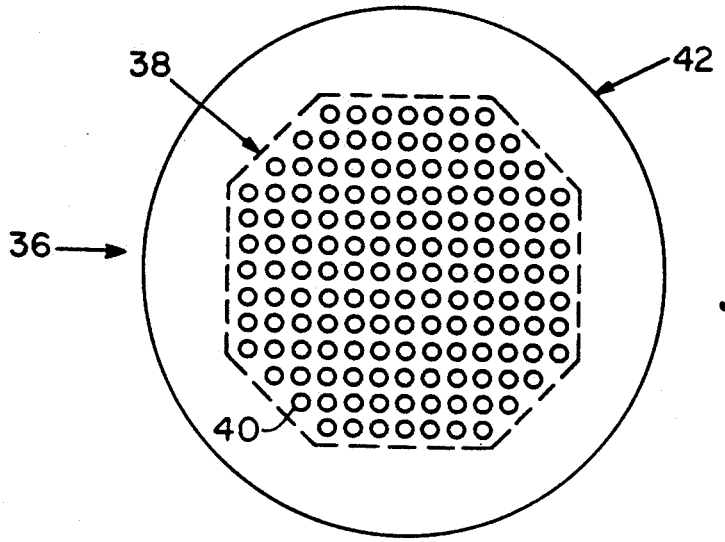
FIG. 3 is a top view of a microchannel plate.
Figure 4:
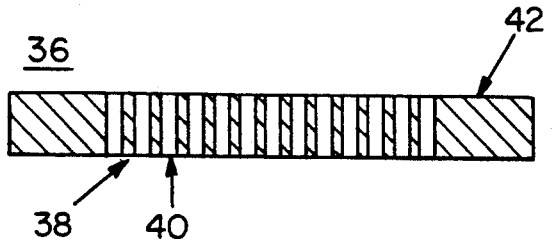
FIG. 4 is a side view of a microchannel plate.

A preferred method of constructing the high angular resolution collimator requires the use of leaded glass micro-channel plate (MCP) detectors. The MCP 36 is an electron multiplier consisting of many bundled channels of optical fibers (microglass capillaries) fused and sliced at their cross section to form a solid core. The solid core takes the shape of a thin plate or wafer. FIGS. 3 and 4 show a top view and a side view of a MCP, respectively. Each channel has a diameter ranging from about 10 to about 20 microns and operates as an independent multiplier. The preferred diameter of the channels is about 10 microns. The plates typically are about 25 mm in diameter. The plates are then processed chemically by an etching process which selectively etches away an inner core of glass 38 leaving behind a plate of microcapillaries 40 and an outer core 42. The capillaries or channels have a diameter in the range of about 10 to 20 microns. The inner core has a diameter of about 18 mm. The microcapillaries 40 are channels comprising very fine holes or pores. Therefore, it can perform electron multiplication while retaining two-dimensional information. Although MCPs are primarily used as electron multipliers, their unique properties are ideally suited for collimator fabrication.

The pore size of the micro-glass capillaries make the fabrication of the high resolution collimators feasible. To achieve an angular resolution of 2.4′ of arc as required for this design, an aspect ratio (tube length to hole diameter) of about 1500 is needed. This means that for a collimator length of 15 mm, the hole diameter must be 10 microns. MCPs are available with hole diameters of 10 microns, but not with a length of 15 mm. The reason being that the etching process for the MCP is diffusion limited to about 1–2 mm for this hole size.

The present invention has solved this fabrication problem by stacking a plurality of individual plates adjacent to each other. The stack of individual plates are aligned in a manner wherein each of the holes from the adjacent plates are in exact registration. Without proper registration, the collimator will essentially be closed to the passage of x-rays.

Figure 5A:
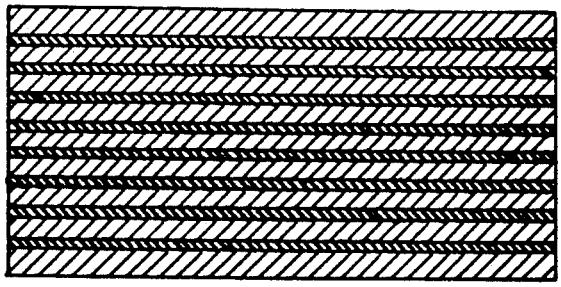
FIGS. 5a–5d are side views showing the process of producing the high angular resolution collimator.
Figure 5B:
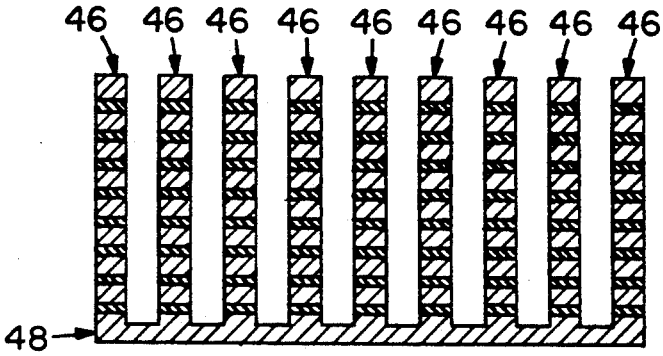
Figure 5C:
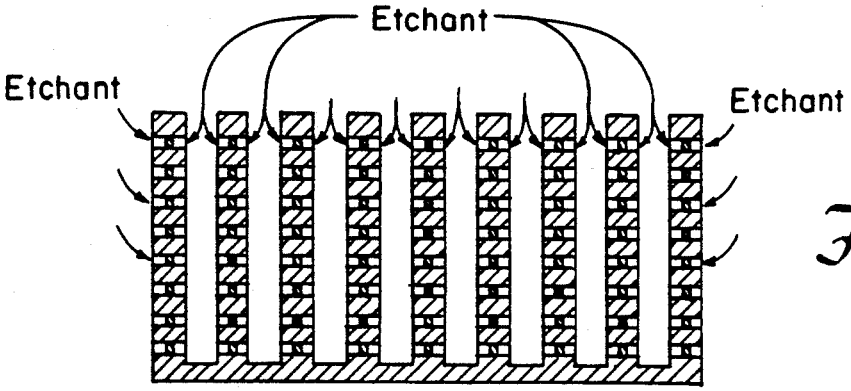
Figure 5D:
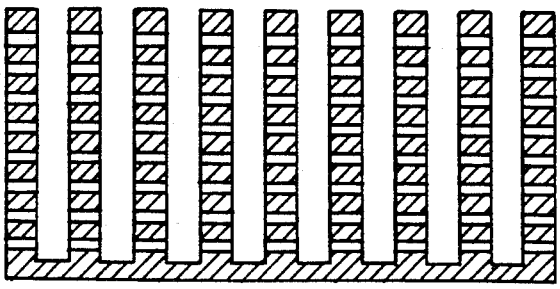

To achieve alignment of the capillary holes from adjacent MCP slices, a solid core of fused glass fibers is provided as shown in FIG. 5*a*. FIG. 5*b* shows the stack of plates after being partially sliced, leaving a portion of the outer core intact to preserve registration. The bundle is cut only part of the way through (about 0.5 mm), leaving a sufficient thickness of the solid glass bundle intact to provide the necessary rigidity and alignment. By repeating this process along the length of the bundle, the individual cuts define a plurality of leaves 46 all attached to a common base 48 and rigidly held. Since the alignment of the fibers in the bundle is nearly perfect over finite lengths, each leaf in the structure will have excellent registration with the adjacent plates. With narrow cuts between the plates, each plate can be chemically etched independently of the others without disrupting the registration. FIG. 5*c* shows the stack of plates as etchant such as a hydrofluoric acid is applied to the inner core to form a plurality of micro-capillaries. The etched MCPs are shown in FIG. 5*d* with the capillaries shown in precise alignment. Once stacked, the geometry must be preserved with some sort of collar or housing as shown in FIG. 6.

Another approach which provides tolerances and mechanical support is slicing all the way through the solid core after forming one or more grooves along the side of the outer core. All of the cuts made along the length of the solid core allow each slice to be etched independently thus eliminating the diffusion problem.

Figure 6:
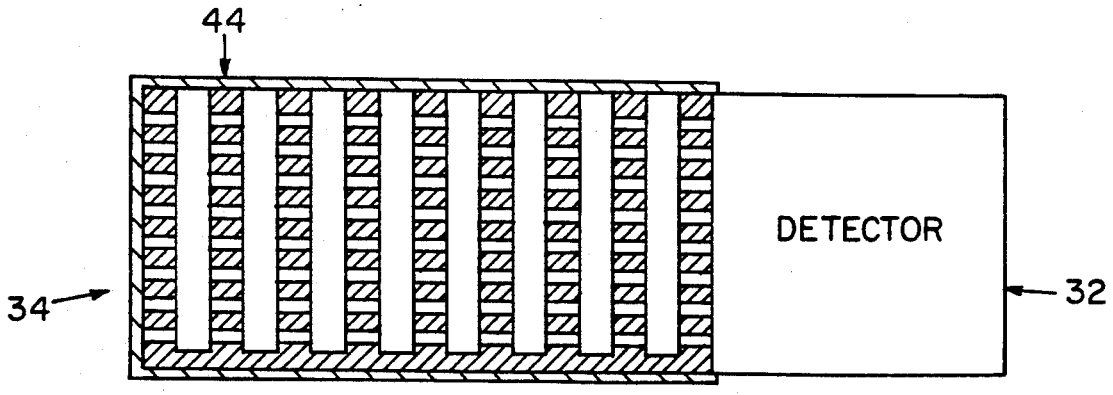
FIG. 6 is a side view of the high angular resolution collimator.
Figure 7A:
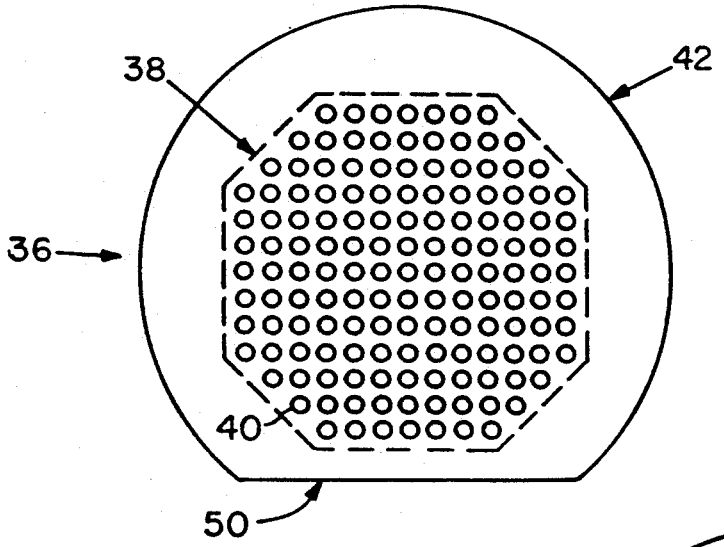
FIG. 7a is another preferred embodiment employing a flat groove for alignment.
Figure 7B:
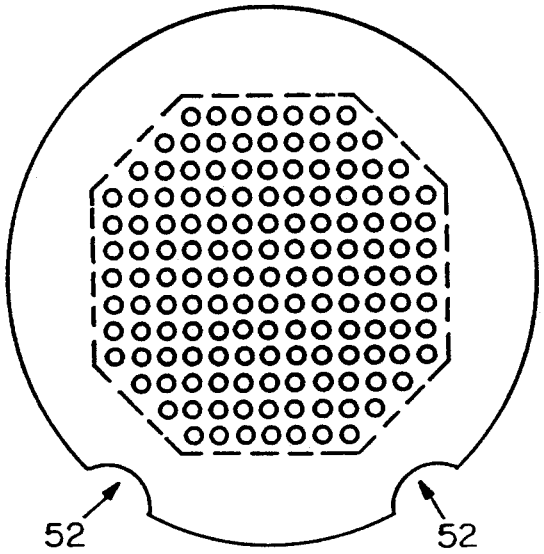
FIG. 7b is another embodiment with a curved groove.
Figure 7C:
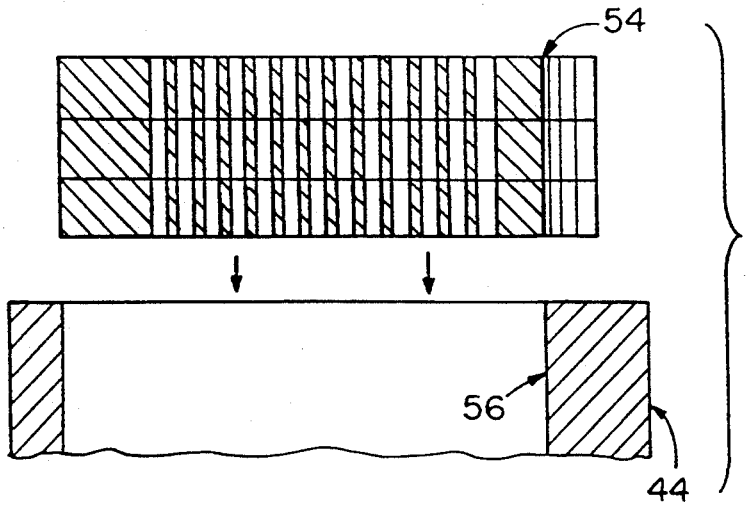
FIG. 7c illustrates a stacked configuration of plates with the grooves aligning the plates.

The housing 44 illustrated in FIG. 6 can be provided with one or more alignment ridges along its inner face that mates with the grooves referenced above. Such a stacked system is shown in FIGS. 7*a–c*. FIG. 7*a* shows a flat groove 50. FIG. 7*b* shows a curved groove 52. FIG. 7*c* shows a stacked array of plates with grooves 54 in alignment which mate with internal ridge 56 of the housing 44. Thus, a high resolution collimator from individually stacked MCPs can be constructed. Finally, the glass material is heavily doped with up to 60% lead in the form of lead oxide. After doping, the collimator has the necessary absorptive properties for stopping high energy x-rays impinging outside the solid angle of the collimator.

The efficiency of this collimator is determined from the product of the solid angle subtended by a single collimator hole and the fractional transparent area of the entrance side of the collimator. The general relationship is defined as:

$$\epsilon = \frac{d^4}{4\pi\, a^2(d + t)^2} \qquad (2)$$

where d is the hole diameter, a is the collimator length and t is the thickness of the septal wall between holes. From the foregoing, it will be seen that a collimator has been provided with improved high angular resolution.

Those skilled in the art will know, or be able to ascertain using no more than routine experimentation, many equivalents to the specific embodiments of the invention described herein. These and all other equivalents are intended to be encompassed by the following claims.

We claim:

1. A collimator, comprising:

a bundle of optical fibers bonded together to form a solid core, the solid core having an inner core and an outer core, the inner core having a plurality of pores therein, the outer core being sliced partially and leaving a portion of the outer core intact to provide a stack of plates with the pores aligned in registration ensuring passage of an x-ray beam, therethrough; and a housing enclosing the stack of plates to preserve registration of the pores.

2. A collimator according to claim 1, wherein the partially sliced core defines a plurality of individual leaves attached to a common base.

3. A collimator according to claim 2, wherein the outer core is sliced about 0.5 mm.

4. A collimator according to claim 1, wherein the optical fibers are glass.

5. A collimator according to claim 1, wherein the stack of plates have a thickness of about 15 mm.

6. A collimator according to claim 1, wherein the stack of plates are doped with up to 60% lead oxide.

7. A collimator according to claim 1, wherein the inner core has a diameter of about 18 mm.

8. A collimator according to claim 7, wherein the outer core has a diameter of about 25 mm.

9. A collimator according to claim 8, wherein the pores have a diameter in the range of about 10 microns to about 20 microns.

10. A high angular resolution x-ray collimator, comprising:

a plurality of plates stacked adjacent to each other, each plate being formed from a bundle of bonded glass fibers, the stack of plates having an inner core and an outer core, the inner core having a plurality of holes formed by removal of a fiber core from each glass fiber such that the holes in each plate are aligned in registration to permit passage of x-rays therethrough; and a collar containing the stack of plates such that registration between aligned holes on adjacent plates is maintained.

11. A high angular resolution x-ray collimator according to claim 10, wherein the stack of plates has a thickness of about 15 mm.

12. A high angular resolution x-ray collimator according to claim 10, wherein the stack of plates are sliced partially along its length.

13. A collimator according to claim 12, wherein the stack of plates are doped with up to 60% lead oxide.

14. A collimator according to claim 13, wherein the partially sliced core defines a plurality of individual leaves attached to a common base.

15. A collimator according to claim 10, wherein the stack of plates have a thickness of about 15 mm.

16. A collimator according to claim 10, wherein the inner core has a diameter of about 18 mm.

17. A collimator according to claim 10, wherein the outer core has a diameter of about 25 mm.

18. A collimator according to claim 10, wherein the plurality of holes within the inner core each have a diameter of about 10 microns to about 20 microns.

19. An x-ray diffraction inspection system for detecting crystalline materials, that are within parcels being inspected comprising:

a light source irradiating a parcel being inspected with an x-ray beam;

a collimator for excluding unwanted x-rays scattered from the object, the collimator comprising a plurality of plates stacked adjacent to each other, each plate being formed from a bundle of bonded glass fibers, the stack of plates having an inner core and an outer core, the inner core having a plurality of holes aligned in registration to ensure passage of wanted x-rays therethrough, and a housing containing the stack of plates to provide registration between holes in adjacent plates; and a detector for measuring the intensity of scattered light passed through the collimator.

20. An x-ray diffraction inspection system according to claim 19, wherein the stack of plates has a thickness of about 15 mm.

21. An x-ray diffraction inspection system according to claim 19, wherein the stack of plates are sliced partially along its length.

22. An x-ray diffraction inspection system according to claim 21, wherein the stack of plates are doped with up to 60% lead oxide.

23. An x-ray diffraction inspection system according to claim 22, wherein the partially sliced core defines a plurality of individual leaves attached to a common base.

24. An x-ray diffraction inspection system according to claim 19, wherein the stack of plates have a thickness of about 15 mm.

25. An x-ray diffraction inspection system according to claim 19, wherein the inner core has a diameter of about 18 mm.

26. An x-ray diffraction inspection system according to claim 19, wherein the outer core has a diameter of about 25 mm.

27. An x-ray diffraction inspection system according to claim 19, wherein the plurality of holes within the inner core each have a diameter of about 10 microns.

28. A method of producing a collimator, comprising the steps of:

fusing a bundle of optical fibers;

cutting the bundle of optical fibers along its length to make a plurality of plates;

etching an inner core within the plates to remove a portion of each optical fiber to provide holes extending through each plate; and stacking the plurality of plates to align the holes through adjacent plates such that the holes are in registration.

29. A method according to claim 28, further comprising the step of doping the plates in lead oxide.

30. A method according to claim 28, wherein the bundle of fibers is partially cut therethrough.

31. A method according to claim 30, wherein the bundle is cut about 0.5 mm.

32. A method according to claim 28, wherein the stack of plates have a thickness of about 15 mm.

33. A method according to claim 28, wherein the inner core has a diameter of about 18 mm.

34. A method according to claim 28, wherein the plurality of holes within the inner core each have a diameter of about 10 microns.

35. A method according to claim 28, further comprising the step of machining a flat in the bundle of fibers before cutting.

36. A method according to claim 28, further comprising the step of preserving the etched plates in exact registration.

37. A method according to claim 28 wherein optical fibers are made of glass.

38. A method of producing a collimator, comprising the steps of:

fusing a bundle of optical fibers;

machining a flat in the bundle of optical fibers;

cutting the bundle of optical fibers along its length forming individual plates;

etching an inner core of each plate to remove material from the optical fibers to form holes extending through each plate;

stacking the plates adjacent to each other;

aligning the plates such that the holes through adjacent plates are in registration;

housing the stacked plate to preserve registration; and doping the housing with lead oxide.

39. A method according to claim 38, wherein the optical fibers are made of glass.

40. A method according to claim 38, wherein the bundle of fibers is partially cut therethrough.

41. A method according to claim 38, wherein the bundle is cut about 0.5 mm.

42. A method according to claim 38, wherein the stack of plates have a thickness of about 15 mm.

43. A method according to claim 38, wherein the inner core has a diameter of about 18 mm.

44. A method according to claim 38, wherein the plurality of holes within the inner core each have a diameter of about 10 microns.

45. A method of x-ray diffraction inspection for detecting crystalline materials within parcels being inspected, comprising:

irradiating a parcel with an x-ray beam;

collimating x-rays from the parcel with a collimator which excludes unwanted x-rays scattered from the object, the collimator comprising a plurality of plates stacked adjacent to each other, each plate being formed from a bundle of bonded glass fibers, the stack of plates having an inner core and an outer core, the inner core having a plurality of holes aligned in registration to permit passage of x-rays through the aligned holes, and a housing containing the stack of plates to preserve registration; and detecting the intensity of scattered light passed through the collimator.

46. The method of claim 45, further comprising providing the stack of plates having a thickness of about 15 mm.

47. The method of claim 45, further comprising providing the stack of plates which are sliced partially to form gaps between the plates.

48. The method of claim 45 wherein the crystalline material comprises a narcotic.

49. The method of claim 45 wherein the crystalline material comprises an explosive.

* * * * *